US006903636B2

(12) United States Patent
Fischer

(10) Patent No.: US 6,903,636 B2
(45) Date of Patent: Jun. 7, 2005

(54) SHOCK RESISTANT AUXILIARY SWITCH MECHANISM AND CIRCUIT BREAKER

(75) Inventor: Kenneth M. Fischer, Finleyville, PA (US)

(73) Assignee: Eaton Corporation, Cleveland, OH (US)

( * ) Notice: Subject to any disclaimer, the term of this patent is extended or adjusted under 35 U.S.C. 154(b) by 176 days.

(21) Appl. No.: 10/463,962

(22) Filed: Jun. 18, 2003

(65) Prior Publication Data

US 2004/0257180 A1 Dec. 23, 2004

(51) Int. Cl.[7] ..... H01H 75/00

(52) U.S. Cl. ..... 335/13; 335/17; 200/553; 200/557; 200/561; 200/562; 200/563

(58) Field of Search ..... 200/303, 307, 200/553, 557, 561–563; 335/6–21

(56) References Cited

U.S. PATENT DOCUMENTS 4,209,761 A * 6/1980 Klein et al. ..... 335/17
4,211,989 A * 7/1980 Acampora ..... 335/17
4,314,121 A * 2/1982 Gaber ..... 200/433
4,418,254 A * 11/1983 Busby et al. ..... 200/433
4,831,221 A * 5/1989 Yu et al. ..... 200/553
5,172,088 A * 12/1992 Morgan ..... 335/201
5,880,419 A * 3/1999 Chou ..... 200/6 R
5,907,461 A * 5/1999 Hartzel et al. ..... 361/42

* cited by examiner

*Primary Examiner*—Ramon M. Barrera
(74) *Attorney, Agent, or Firm*—Martin J. Moran

(57) ABSTRACT

An improved shock resistant auxiliary switch mechanism for a circuit breaker includes a common conductor having a conduction plate that is slidably translatable between electrically conductive contact with first and second conductors. The conduction plate is biased by a spring in a direction toward contact with the first conductor. An improved shock resistant circuit breaker including the improved auxiliary switch mechanism includes a crossbar that is operatively engageable with the conduction plate to releasably retain the conduction plate in a position in contact with the second conductor. When the circuit breaker is in an ON position, the conduction plate is operatively interposed between the crossbar and the bias of the spring.

18 Claims, 4 Drawing Sheets

SHOCK RESISTANT AUXILIARY SWITCH MECHANISM AND CIRCUIT BREAKER

CROSS-REFERENCE TO RELATED APPLICATION

This application is related to commonly assigned, concurrently filed U.S. patent application Ser. No. 10/463,989, filed Jun. 18, 2003, entitled "Shock Resistant Bell Alarm Switch Mechanism And Circuit Breaker".

BACKGROUND OF THE INVENTION

1. Field of the Invention

The present invention relates generally to circuit breakers and, more particularly, to a shock resistant auxiliary switch mechanism for a circuit breaker.

2. Description of the Related Art

Circuit breakers are used for numerous purposes in power distribution systems. Among such purposes is the interruption of current in a protected system during specified conditions.

Each pole of a circuit breaker includes a stationary contact and a movable contact, with the movable contact typically being mounted on an arm that can pivot the movable contact into and out of the electrical engagement with the stationary contact. A multi-pole circuit breaker typically includes a single operating mechanism for all of the poles, with the operating mechanism including a single crossbar and a single cradle. The crossbar extends between all of the poles and synchronizes the operation thereof. The cradle is operable to pivot the crossbar in order to separate the movable contacts from the stationary contacts in the event of a trip situation.

A circuit breaker can be in any one of an ON position, an OFF position, and a TRIPPED position. The movable contacts are connected with the stationary contacts when the circuit breaker is in the ON position. The cradle is a mechanism, usually spring-operated, that is operable to switch the circuit breaker from the ON position to the TRIPPED position by pivoting the crossbar to separate the movable contacts from the stationary contacts. When the cradle is mechanically energized, such as loading the springs thereof, a handle of the circuit breaker can be employed to switch the circuit breaker between the ON position and the OFF position by pivoting the crossbar such that the movable contacts are moved into and out of engagement with the stationary contacts.

While the specific condition of a circuit breaker often is plain to an observer, it is nevertheless often desirable to provide additional apparatuses to indicate to a technician the condition of the circuit breaker. For instance, some circuit breakers include an auxiliary switch that is operated by the crossbar and indicates the condition of the contacts as either being connected or disconnected, meaning that it indicates whether the circuit breaker is in the ON position or is in either of the OFF and TRIPPED positions. Alternatively, or in addition thereto, a circuit breaker may include a bell alarm switch that is operated by the cradle to indicate whether the circuit breaker is in the TRIPPED position or in one of the ON and OFF positions. While such auxiliary switches and bell alarm switches have been generally effective for their intended purposes, such switches have not, however, been without limitations.

Depending upon the application, a circuit breaker may be subjected to shock loading. Different applications have different requirements for the continued operation of circuit breakers during shock loading. Known auxiliary switches typically include a microswitch having a common conductor that is pivotable about an axis, with the pivotable portion having a asymmetric distribution of mass about the pivot point. Such asymmetry can result in unintended rotation of the common conductor in the event of a shock loading, which can undesirably result in an incorrect indication of the condition of the contacts and/or cradle. It is thus desired to provide an improved auxiliary switch mechanism and resulting circuit breaker that are configured to resist the effect of shock loading.

SUMMARY OF THE INVENTION

An improved shock resistant auxiliary switch mechanism and resulting circuit breaker in accordance with the present invention meet these and other needs. An improved shock resistant auxiliary switch mechanism for a circuit breaker includes a common conductor having a conduction plate that is slidably translatable between electrically conductive contact with first and second conductors. The conduction plate is biased by a spring in a direction toward contact with the first conductor. An improved shock resistant circuit breaker including the improved auxiliary switch mechanism includes a crossbar that is operatively engageable with the conduction plate to releasably retain the conduction plate in a position in contact with the second conductor. When the circuit breaker is in an ON position, the conduction plate is operatively interposed between the crossbar and the bias of the spring.

Accordingly, an aspect of the present invention is to provide an auxiliary switch mechanism and a resulting circuit breaker that are resistant to shock loading.

Another aspect of the present invention is to provide a shock resistant auxiliary switch mechanism for use in a circuit breaker, with the auxiliary switch mechanism including a first conductor, a second conductor, and a common conductor, and with the common conductor including a slidably translatable conduction plate that is alternately connectable with the first and second conductors.

Another aspect of the present invention is to provide a shock resistant auxiliary switch mechanism for use in a shock resistant circuit breaker having a crossbar, with the auxiliary switch mechanism including a common conductor having a conduction plate that is movable between a first position and a second position and that is biased by a spring toward the first position, with the crossbar being operatively engageable with the conduction plate to releasably retain the conduction plate in the second position, whereby the conduction plate is operatively interposed between the crossbar and the bias of the spring.

Accordingly, an aspect of the present invention is to provide an improved shock resistant auxiliary switch mechanism for use in a circuit breaker, with the circuit breaker including a set of separable contacts, and with the auxiliary switch mechanism being structured to indicate a disconnected state of the set of contacts, in which the general nature of the auxiliary switch mechanism can be stated as including a frame, a switch assembly, and a biasing member. The switch assembly is mounted on the frame and includes a first conductor, a second conductor, a common conductor, and an actuator. The actuator is operatively engaged with the common conductor to slidably move at least a portion of the common conductor between a first position in which the common conductor is connected with the first conductor and a second position in which the common conductor is connected with the second conductor. The biasing member biases the actuator toward the first position. The actuator is structured to be engaged by a movable member of the circuit breaker to releasably retain the actuator in the second position whereby the actuator is operationally interposed between the bias of the biasing member and the movable member of the circuit breaker to resist unintended movement of the at least portion of the common conductor due to a shock event.

Another aspect of the present invention it to provide an improved shock resistant auxiliary switch mechanism for use in a circuit breaker, with the circuit breaker including a set of separable contacts, and with the auxiliary switch mechanism being structured to indicate a disconnected state of the set of contacts, in which the general nature of the auxiliary switch mechanism can be stated as including a frame, a switch assembly, and a biasing member. The switch assembly is mounted on the frame and includes a first conductor, a second conductor, a common conductor, and an actuator. The common conductor includes a slidably translatable conduction plate. The actuator is operatively engaged with the conduction plate to slidably translate the conduction plate between a first position connected with the first conductor and a second position connected with the second conductor. The biasing member biases the actuator toward the first position, and the actuator is structured to be operatively engaged by a movable member of the circuit breaker.

Another aspect of the present invention is to provide an improved shock resistant circuit breaker, the general nature of which can be stated as including a line conductor, a load conductor, and a set of separable contacts interposed between the line and load conductors. The set of separable contacts includes a movable contact and a stationary contact, and a movable member is operatively connected with the movable contact. The circuit breaker further includes a shock resistant auxiliary switch mechanism, with the auxiliary switch mechanism including a frame, a switch assembly, and a biasing member. The switch assembly is mounted on the frame. The switch assembly includes a first conductor, a second conductor, a common conductor, and an actuator. The actuator is operatively engaged with the common conductor to slidably move at least a portion of the common conductor between a first position in which the common conductor is connected with the first conductor and a second position in which the common conductor is connected with the second conductor. The biasing member biases the actuator toward the first position. The movable member is operatively engageable with the actuator to releasably retain the actuator in the second position whereby the actuator is operationally interposed between the movable member and the bias of the biasing member to resist unintended movement of the at least portion of the common conductor due to a shock event.

BRIEF DESCRIPTION OF THE DRAWINGS

A further understanding of the invention can be gained from the following Description of the Preferred Embodiment when read in conjunction with the accompanying drawings in which.

Similar numerals refer to similar parts throughout the specification.

DESCRIPTION OF THE PREFERRED EMBODIMENT

Figure 1:
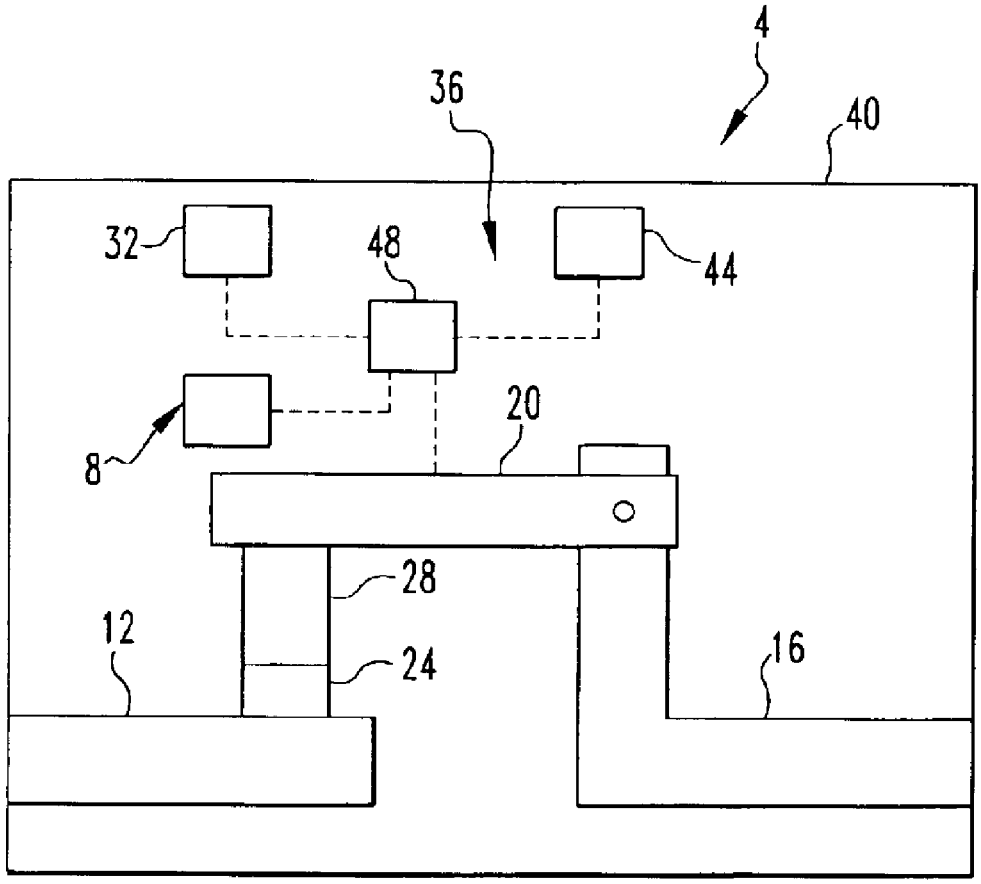
FIG. 1. is a schematic view of an improved circuit breaker in accordance with the present invention that includes an improved auxiliary switch mechanism in accordance with the present invention.

An improved circuit breaker 4 in accordance with the present invention is depicted schematically in FIG. 1. As will be set forth in greater detail below, the circuit breaker 4 includes an improved auxiliary switch mechanism 8 in accordance with the present invention, with the auxiliary switch mechanism 8 being depicted schematically in FIG. 1. The improved circuit breaker 4 and the improved auxiliary switch mechanism 8 advantageously are both configured to resist malfunction due to shock events.

The schematically depicted circuit breaker 4 additionally includes a line conductor 12, a load conductor 16, a movable arm 20, a stationary contact 24, a movable contact 28, a handle 32, an operating mechanism 36, and a case 40. The case 40 provides the support for all of the other components of the circuit breaker 4.

The operating mechanism 36 includes a cradle 44 and a crossbar 48. The crossbar 48 is operatively connected with the movable arm 20 to move the movable contact 28 into and out of engagement with the stationary contact 24, such as when the circuit breaker 4 is moved between the ON position and the OFF or TRIPPED positions. The cradle 44 is operatively connected with the crossbar 48 to move the circuit breaker 4 from the ON position to the TRIPPED position. The handle 32 is operatively connected with the crossbar 48 to move the circuit breaker 4 between the ON position and the OFF position. While it is understood that the handle 32 is operatively connected with the cradle 44 to load the springs of the cradle 44 in a known fashion after the circuit breaker 4 has been tripped, for purposes of clarity such relationship is not explicitly depicted in FIG. 1. It is also understood that the circuit breaker 4 is a multi-pole circuit breaker even though only a single pole is depicted, and it is further understood that the teachings herein can be applied to a single pole circuit breaker without departing from the concept of the present invention.

Figure 4:
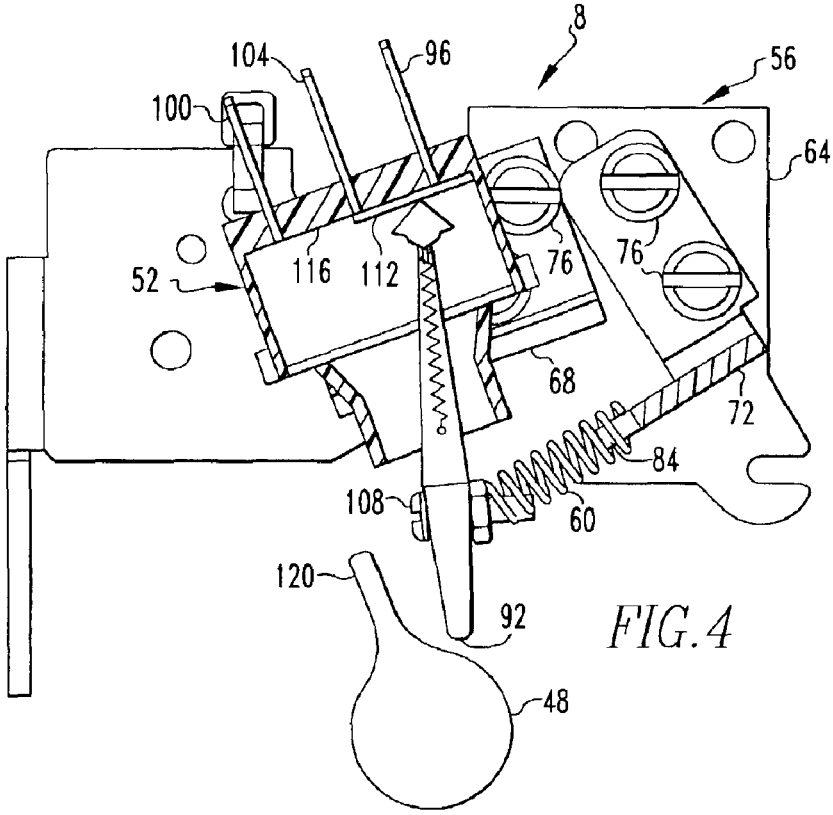
FIG. 4 is a schematic view of the auxiliary switch mechanism and a crossbar of the circuit breaker, with the auxiliary switch mechanism being in a first position.
Figure 5:
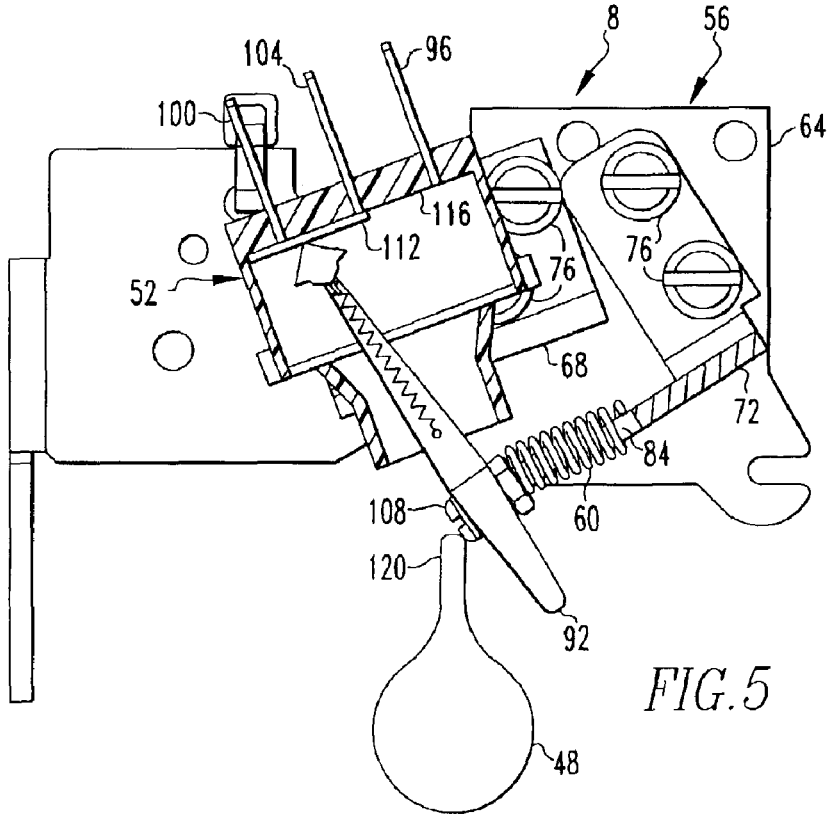
FIG. 5 is a view similar to FIG. 4, except depicting the auxiliary switch mechanism being in a second position.

It can also be seen from FIG. 1 that the crossbar 48 is operatively connected with the auxiliary switch mechanism 8. Such operative engagement is schematically depicted in FIGS. 4 and 5 and will be discussed in greater detail below.

Figure 2:
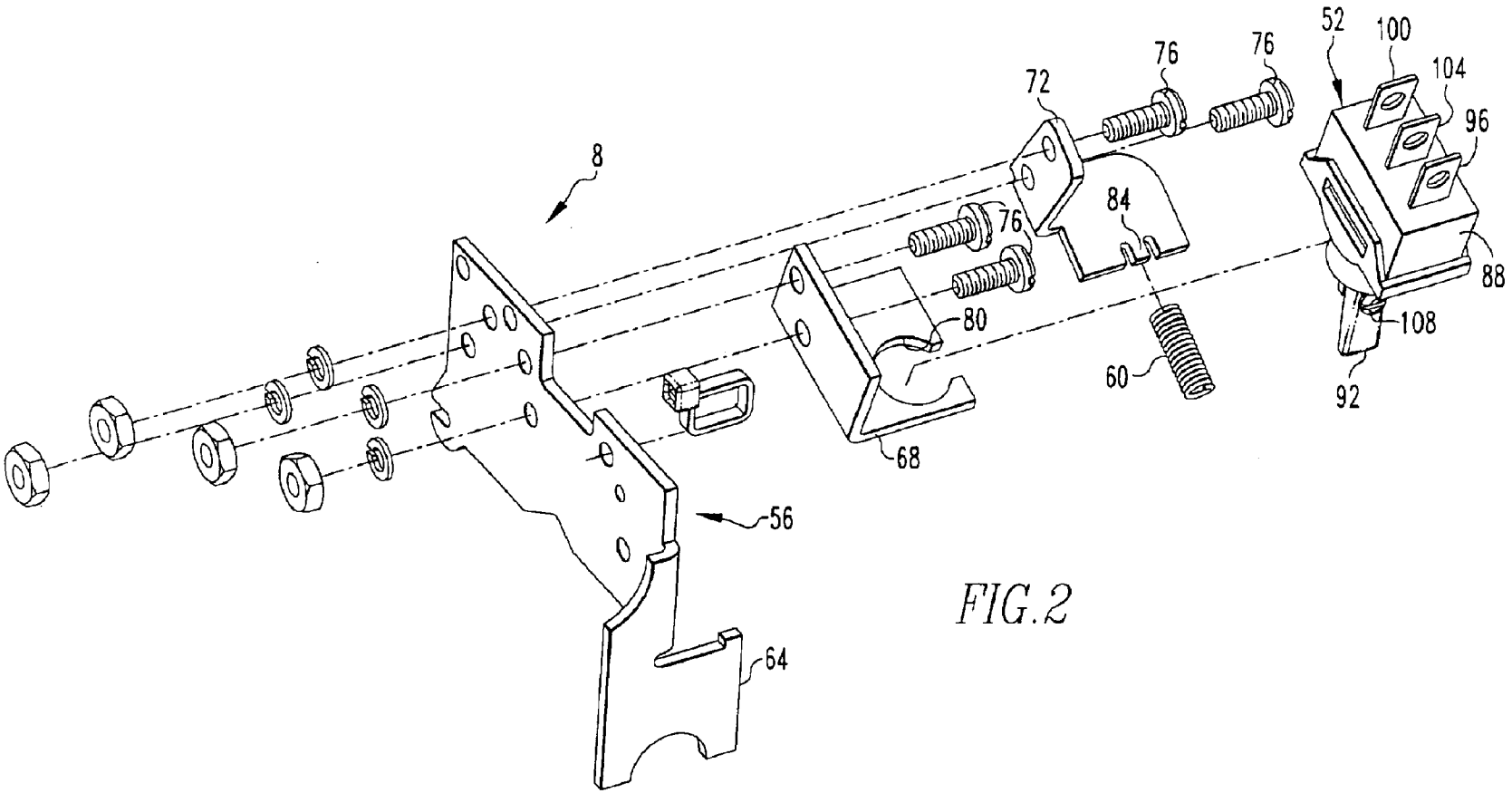
FIG. 2 is an exploded isometric view of the auxiliary switch mechanism.

The auxiliary switch mechanism 8 is depicted in an exploded fashion in FIG. 2. The auxiliary switch mechanism 8 generally includes a switch assembly 52, a frame 56, and a biasing member 60 which, in the depicted embodiment, is a helical compression spring. The switch assembly 52 and the spring 60 are both mounted on the frame 56, and the frame 56 is in turn disposed on the case 40 of the circuit breaker 4.

The frame 56 more specifically includes a first member 64 upon which are mounted a second member 68, and a third member 72. The second and third members 68 and 72 are attached to the first member 64 with a number of fasteners 76 which are depicted in the exemplary embodiment as being screws in combination with nuts and lock washers. The second member 68 includes a mounting hole 80 within which the switch assembly 52 is received. The third member 72 includes a tab 84 for mounting of the spring 60.

Figure 3:
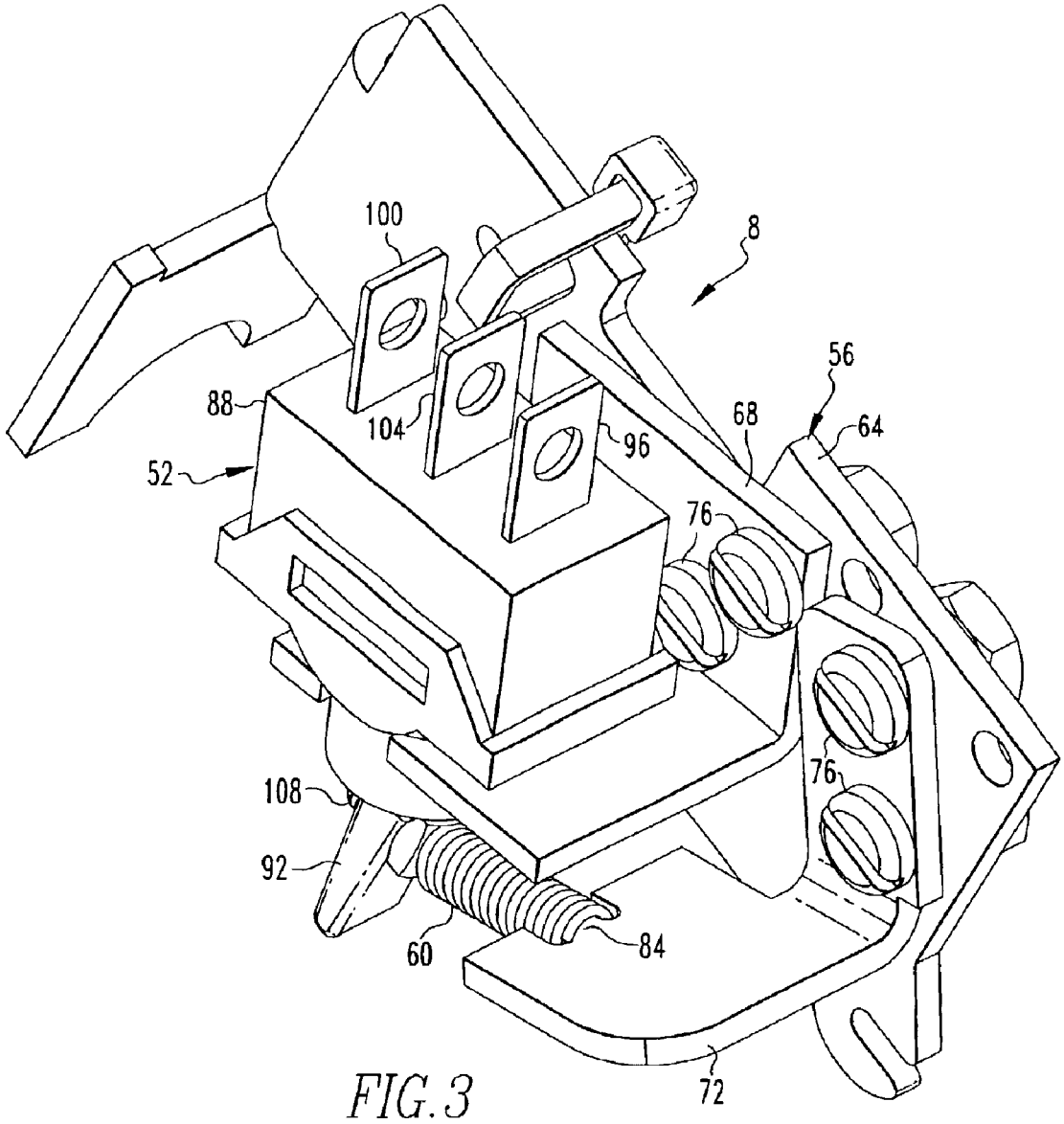
FIG. 3 is an assembled isometric view of the auxiliary switch mechanism from a different perspective than that of FIG. 2.

As can be understood from FIGS. 2-5, the switch assembly 52 includes a housing 88, a toggle 92, a first conductor 96, a second conductor 100, and a common conductor 104. The toggle 92 includes a connector 108 for attachment of the spring 60, and FIG. 3 depicts the spring 60 as extending between the connector 108 and the tab 84. The spring 60 is disposed at the exterior of the housing 88.

As can be seen from FIGS. 4 and 5, the common conductor 104 includes a conduction plate 112 that is slidably translatable on a support surface 116 of the housing 88. The toggle 92 is pivotably disposed on the housing 88, with one end of the toggle 92 being operatively connected with the conduction plate 112 and with a second opposite end of the toggle 92 being operatively connected with the spring 60. The spring 60 thus can be said to be operatively connected with the conduction plate 112 and to operatively extend between the frame 56 and the common conductor 104.

The toggle 92 and the conduction plate 112 are movable between a first position (FIG. 4) and a second position (FIG. 5). In the first position (FIG. 4), the conduction plate 112 is connected with the first conductor 96, whereby the common conductor 104 and the first conductor 96 are electrically conductively connected with one another. In the second position (FIG. 5), the conduction plate 112 is connected with the second conductor 100, whereby the second conductor 100 and the common conductor 104 are electrically conductively connected with one another.

The spring 60 biases the toggle 92 and the conduction plate 112 toward the first position. The toggle 92 and the conduction plate 112 thus are in the first position when the crossbar 48 is disengaged from the toggle 92 (FIG. 4) such as when the circuit breaker 4 is in either the OFF position or the TRIPPED position. In switching the circuit breaker 4 to the ON position (FIG. 5), however, a lobe 120 of the crossbar 48 engages the toggle 92 and overcomes the bias of the spring 60 to move the toggle 92 and the conduction plate 112 to the second position. In such a condition, the crossbar 48 releasably retains the toggle 92 and the conduction plate 112 in the second position while the spring 60 still biases the toggle 92 and the conduction plate 112 toward the first position. When the circuit breaker 4 is in the ON position, therefore, the toggle 92 and the conduction plate 112 are operatively interposed between the crossbar 48 and the bias of the spring 60.

Such operative interposition of the toggle 92 and the conduction plate 112 between the crossbar 48 and the spring 60 resists unintended movement of the toggle 92 and/or the conduction plate 112 away from the second position upon the occurrence of a shock event. The toggle 92 and the conduction plate 112 cannot move away from the second position when the circuit breaker 4 is in the ON position (FIG. 5) unless the crossbar 48 somehow becomes disengaged with the toggle 92, which generally could happen only upon at least partial destruction of the circuit breaker 4. While previously known switches may have included a spring or other biasing system, such springs or biasing systems have previously been configured only to retain the switches in a given position in a static environment and have not been configured to retain the switches in given positions during shock loading.

Additional shock resistance results from the conduction plate 112 being slidably translatable on the support surface 116. Many previously known switches have employed conduction members that are pivotable about an axis and that have an asymmetric weight distribution about the axis, such that in the event of a shock load the asymmetry of the weight distribution can cause the conduction member to pivot slightly and break contact with other conductors in the switch, which is undesirable. Since the conduction plate 112 is translatable, no combination of events could cause an unintended pivoting of the conduction plate 112. As set forth above, the only way in which the conduction plate 112 can move from the second position when the circuit breaker 4 is in the ON condition is for the toggle 92 and the conduction plate 112 to overcome the bias of the spring 60 which, in the ON position, is already compressed to a significant extent.

As can further be understood from FIG. 5, the lobe 120 is engageable with the connector 108 of the toggle 92 when the crossbar 48 and the toggle 92 are engaged with one another. Depending upon the specific selection of materials employed, the bearing of the lobe 120 on the connector 108 instead of on other portions of the toggle 92 can resist frictional wear of the auxiliary switch mechanism 8.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A shock resistant auxiliary switch mechanism for use in a circuit breaker, the circuit breaker including a set of separable contacts, the auxiliary switch mechanism being structured to indicate a disconnected state of the set of contacts, the auxiliary switch mechanism comprising:

a frame;

a switch assembly;

a biasing member;

the switch assembly being mounted on the frame, the switch assembly including a first conductor, a second conductor, a common conductor, and an actuator;

the actuator being operatively engaged with the common conductor to slidably move at least a portion of the common conductor between a first position in which the common conductor is connected with the first conductor and a second position in which the common conductor is connected with the second conductor; and the biasing member biasing the actuator toward the first position, the actuator being structured to be engaged by a movable member of the circuit breaker to releasably retain the actuator in the second position whereby the actuator is operationally interposed between the bias of the biasing member and the movable member of the circuit breaker to resist unintended movement of the at least portion of the common conductor due to a shock event.

2. The auxiliary switch mechanism as set forth in claim 1, in which the biasing member operatively extends between the at least portion of the common conductor and the frame.

3. The auxiliary switch mechanism as set forth in claim 2, in which the switch assembly includes a housing, and in which the at least portion of the common conductor includes a conduction plate, the first, second, and common conductors being mounted on the housing, the actuator being movable with respect to the housing and including a first portion operatively engaged with the conduction plate and a second portion operatively engaged by the biasing member.

4. The auxiliary switch mechanism as set forth in claim 3, in which the biasing member is a helical compression spring.

5. The auxiliary switch mechanism as set forth in claim 3, in which the conduction plate is translatable between the first and second conductors when moving between the first and second positions.

6. The auxiliary switch mechanism as set forth in claim 5, in which the housing includes a support surface, the conduction plate being slidably disposed on the support surface and being translatable between the first and second conductors, the conduction plate being connected with the first conductor when in the first position, the conduction plate being connected with the second conductor when in the second position.

7. A shock resistant auxiliary switch mechanism for use in a circuit breaker, the circuit breaker including a set of separable contacts, the auxiliary switch mechanism being structured to indicate a disconnected state of the set of contacts, the auxiliary switch mechanism comprising:

a frame;

a switch assembly;

a biasing member;

the switch assembly being mounted on the frame, the switch assembly including a first conductor, a second conductor, a common conductor, and an actuator;

the common conductor including a slidably translatable conduction plate;

the actuator being operatively engaged with the conduction plate to slidably translate the conduction plate between a first position connected with the first conductor and a second position connected with the second conductor; and the biasing member biasing the actuator toward the first position, the actuator being structured to be operatively engaged by a movable member of the circuit breaker.

8. The auxiliary switch mechanism as set forth in claim 7, in which the biasing member operatively extends between the actuator and the frame.

9. The auxiliary switch mechanism as set forth in claim 8, in which the switch assembly includes a housing, the first, second, and common conductors being mounted on the housing, the actuator being movable with respect to the housing and including a first portion operatively engaged with the conduction plate and a second portion operatively engaged by the biasing member.

10. The auxiliary switch mechanism as set forth in claim 9, in which the biasing member is a helical compression spring.

11. A shock resistant circuit breaker comprising:

a line conductor;

a load conductor;

a set of separable contacts interposed between the line and load conductors;

the set of separable contacts including a movable contact and a stationary contact;

a movable member operatively connected with the movable contact; and a shock resistant auxiliary switch mechanism;

the auxiliary switch mechanism including a frame, a switch assembly, and a biasing member, the switch assembly being mounted on the frame;

the switch assembly including a first conductor, a second conductor, a common conductor, an actuator;

the actuator being operatively engaged with the common conductor to slidably move at least a portion of the common conductor between a first position in which the common conductor is connected with the first conductor and a second position in which the common conductor is connected with the second conductor; and the biasing member biasing the actuator toward the first position, the movable member being operatively engageable with the actuator to releasably retain the actuator in the second position whereby the actuator is operationally interposed between the movable member and the bias of the biasing member to resist unintended movement of the at least portion of the common conductor due to a shock event.

12. The circuit breaker as set forth in claim 11, in which the at least portion of the common conductor includes a conduction plate that is slidably movable between the first and second positions.

13. The circuit breaker as set forth in claim 12, in which the biasing member is a spring that operatively extends between the conduction plate and the frame.

14. The circuit breaker as set forth in claim 13, in which the switch assembly includes a housing, the first, second, and common conductors being mounted on the housing, the actuator being movable with respect to the housing and including a first portion operatively engaged with the conduction plate and a second portion operatively engaged by the spring.

15. The circuit breaker as set forth in claim 14, in which the spring is a helical compression spring.

16. The circuit breaker as set forth in claim 14, in which the actuator is a pivotable toggle;

the movable member being a crossbar.

17. The circuit breaker as set forth in claim 12, in which the conduction plate is slidably translatable when moving between the first and second positions.

18. The circuit breaker as set forth in claim 17, in which the switch assembly includes a housing, the housing including a support surface, the conduction plate being slidably disposed on the support surface and being translatable on the support surface between the first and second positions.

* * * * *